US006520792B2

(12) United States Patent
Chen-Chiang et al.

(10) Patent No.: US 6,520,792 B2
(45) Date of Patent: Feb. 18, 2003

(54) ADJUSTABLE SECURING DEVICE

(75) Inventors: Su Chen-Chiang, Taoyuan (TW); Chen Yuan-Sheng, Hsinchu (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/952,149

(22) Filed: Sep. 14, 2001

(65) Prior Publication Data

US 2002/0068477 A1 Jun. 6, 2002

Related U.S. Application Data

(63) Continuation-in-part of application No. 09/729,476, filed on Dec. 4, 2000, now abandoned.

(51) Int. Cl.[7] ..... H01R 13/62
(52) U.S. Cl. ..... 439/373
(58) Field of Search ..... 439/310, 373, 439/371

(56) References Cited

U.S. PATENT DOCUMENTS 1,188,568 A 6/1916 Smith
3,811,104 A * 5/1974 Caldwell ..... 439/135
4,424,407 A * 1/1984 Barbic ..... 174/67
4,662,697 A * 5/1987 Moses ..... 174/67
4,959,021 A * 9/1990 Byrne ..... 439/1
5,044,976 A * 9/1991 Thompson ..... 439/368
5,348,495 A * 9/1994 Kasden ..... 439/371
5,655,924 A * 8/1997 Cross et al. ..... 439/369
5,928,023 A * 7/1999 Buckner et al. ..... 439/371
6,155,867 A * 12/2000 Chou ..... 439/320
6,276,952 B1 * 8/2001 Ferranti et al. ..... 439/345

* cited by examiner

*Primary Examiner*—Lynn D. Feild
*Assistant Examiner*—Phuong Dinh
(74) *Attorney, Agent, or Firm*—Mathews, Collins, Shepherd & McKay, P.A.

(57) ABSTRACT

An adjustable securing device capable of tightly securing various sizes of plugs to a socket for use in an electric appliance is disclosed. The adjustable securing device includes a casing having a first receptacle for retaining the socket therein and a second receptacle adjacent to the first receptacle, a holder slidably mounted in the second receptacle of the casing and having one portion exposed from the casing for supporting and retaining various sizes of plugs, a resilient element disposed in the casing and having a first engaging element thereon, and a slider having a second engaging element for engaging with the first engaging element of the resilient element and slidably disposed under the holder for regulating and securing the position of the holder relative to the casing, thereby causing the various sizes of plugs to be tightly secured to the socket.

11 Claims, 7 Drawing Sheets

ADJUSTABLE SECURING DEVICE

This application is a continuation-in-part application of the application Ser. No. 09/729,476 filed Dec. 4, 2000 now abandoned.

FIELD OF THE INVENTION

The present invention relates to a securing device, and more particularly to an adjustable securing device which can tightly secure various sizes of plugs to a socket.

BACKGROUND OF THE INVENTION

Nowadays electric appliances are widely used in every home or working office. Each electric appliance needs to be plugged into a socket, and therefore electrical energy can be transferred from the power source to the electric appliance.

The conventional connector assembly essentially includes a plug and a socket which are engaged with each other. It is common that the plug is inadvertently removed from the socket. Thus, the supplying electricity is interrupted. The interrupted supplying electricity can not only result in an inconvenience, but also cause damage to the electric appliances.

In order to overcome the problems described above, the present invention provides an adjustable securing device for tightly securing various sizes of plugs to a socket disposed on an electric appliance.

SUMMARY OF THE INVENTION

It is therefore an object of the present invention to provide an adjustable securing device for tightly securing various sizes of plugs to a socket disposed on an electric appliance.

In order to achieve the above-mentioned objects, an adjustable securing device capable of tightly securing various sizes of plugs to a socket for use in an electric appliance is provided. The adjustable securing device includes a casing having a first receptacle for retaining the socket therein and a second receptacle adjacent to the first receptacle, a holder slidably mounted in the second receptacle of the casing and having one portion exposed from the casing for supporting and retaining various sizes of plugs, a resilient element disposed in the casing and having a first engaging element thereon, and a slider having a second engaging element for engaging with the first engaging element of the resilient element and slidably disposed under the holder for regulating and securing the position of the holder relative to the casing, thereby causing various sizes of plugs to be tightly secured to the socket.

In accordance with one aspect of the present invention, the adjustable securing device further includes a cover mounted in the casing for covering the other portion of the holder and guiding the holder and slider to slide therein.

In accordance with another aspect of the present invention, the cover has a hole for mounting a screw therethrough to secure the cover to the casing. The holder has a first slot for mounting the screw therethrough, whereby the holder is capable of being slid in the second receptacle within the length of the first slot. The slider has a second slot corresponding to the first slot of the holder for mounting the screw therethrough, whereby the slider is capable of being slid under the holder within the length of the second slot.

In accordance with another aspect of the present invention, the resilient element includes at least one resilient piece, each of which has a middle bended portion attached to the casing and two free ends spaced apart a specific distance from the bottom of the casing, wherein the first engaging element is disposed on one of two free ends. Preferably, the first engaging element of the resilient piece is a tenon and the second engaging element of the slider is plural holes for engaging with the tenon. More preferably, the holder further includes plural of through holes and the resilient piece further includes another tenon disposed on the other free end thereof for engaging with the through holes of the holder.

In accordance with another aspect of the present invention, the slider further includes a screw for securing the holder to the slider by screwing the screw to bias against the undersurface of the holder when the holder is moved and regulated to a desired position relative to the casing, thereby tightly securing various sizes of plugs to the socket.

Preferably, the holder has a retaining element for retaining the plug thereon.

In accordance with one aspect of the present invention, the holder further includes a plate, and two flanges downwardly extending from two opposite rims of the plate for defining a space with the undersurface of the plate to receive the slider.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1:
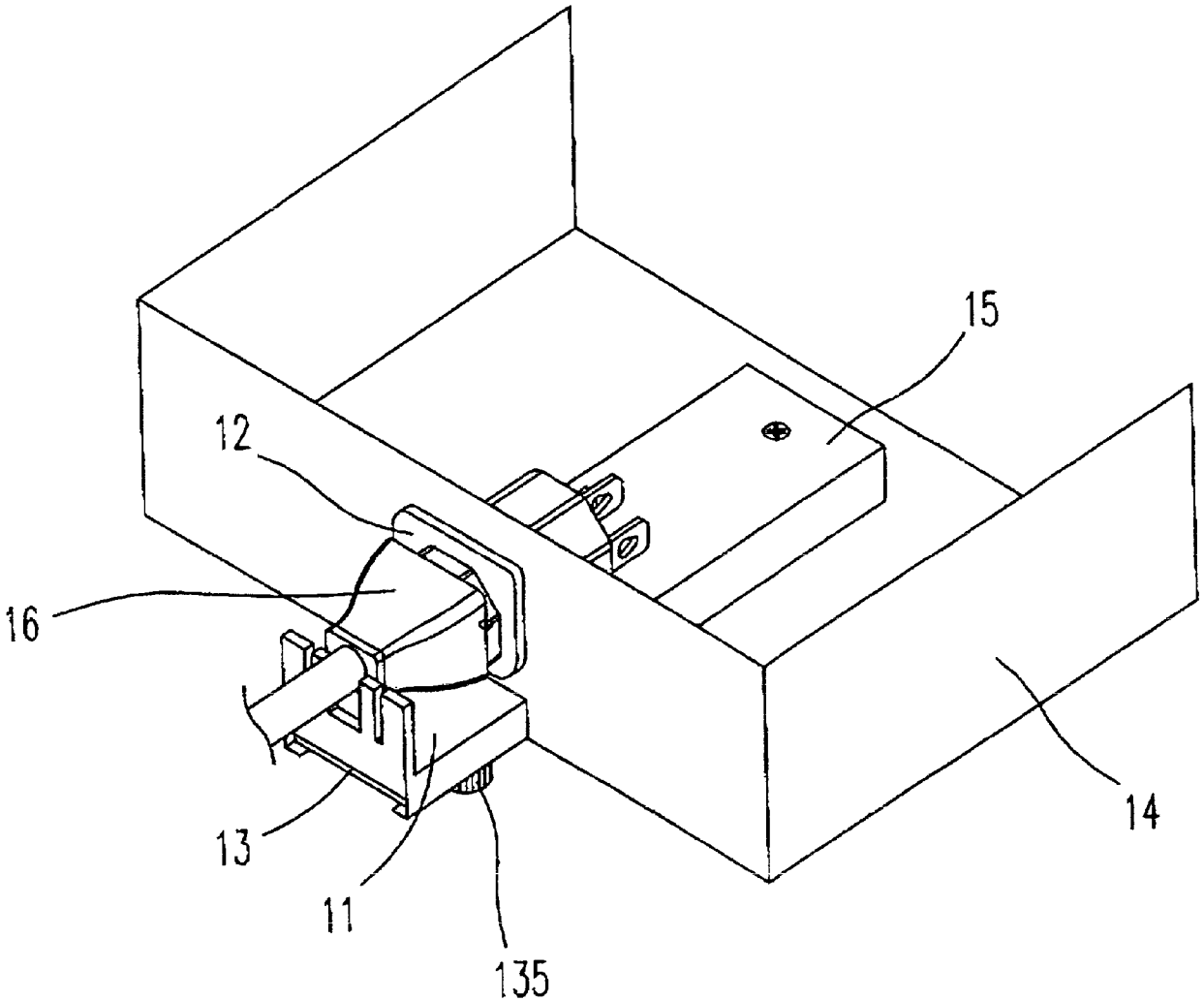
FIG. 1 is a perspective view showing the adjustable securing device according to the preferred embodiment of the present invention.

A preferred embodiment of the present invention is described in detail with reference to the drawings. The view of the adjustable securing device according to the present invention is shown in FIG. 1, and every component present in FIG. 1 is illustrated in FIG. 2.

The adjustable securing device of the present invention is capable of tightly securing various sizes of plugs 16 to a socket 12 for use in an electric appliance. As shown in FIGS. 1 and 2, the adjustable securing device of the present invention includes a casing 14, a holder 11, a slider 13, a resilient element 21, and a cover 15. The casing 14 has a first receptacle 141 and a second receptacle 142 simultaneously formed on one side thereof, where the first receptacle 141 is capable of retaining a socket 12 therein and the second receptacle 142 is disposed adjacent to the first receptacle 141. Preferably, both the first and second receptacles are openings. The holder 11 is slidably mounted in the second receptacle 141, and portion of the holder 11 is exposed from the casing 14 for supporting and retaining various sizes of plugs 16 thereon.

Please refer to FIG. 2 again. As shown in FIG. 2, the holder 11 includes a plate 110, two L-shaped flanges 111 downwardly extending from two opposite rims of the pate 110, a retain element 112 upwardly extending from one end of the plate 110, a longitudinal slot 113 disposed on the plate 110, two ear element 114 and 115 disposed on the undersurface of the plate 110, and plural through holes 116 and 117 formed on the plate 110 adjacent to the other end. The retaining element 112 has a notch 1121 for retaining a plug or a cable of the plug therein, whereby the plug 16 can be secured on the holder 11 stably.

Figure 2:
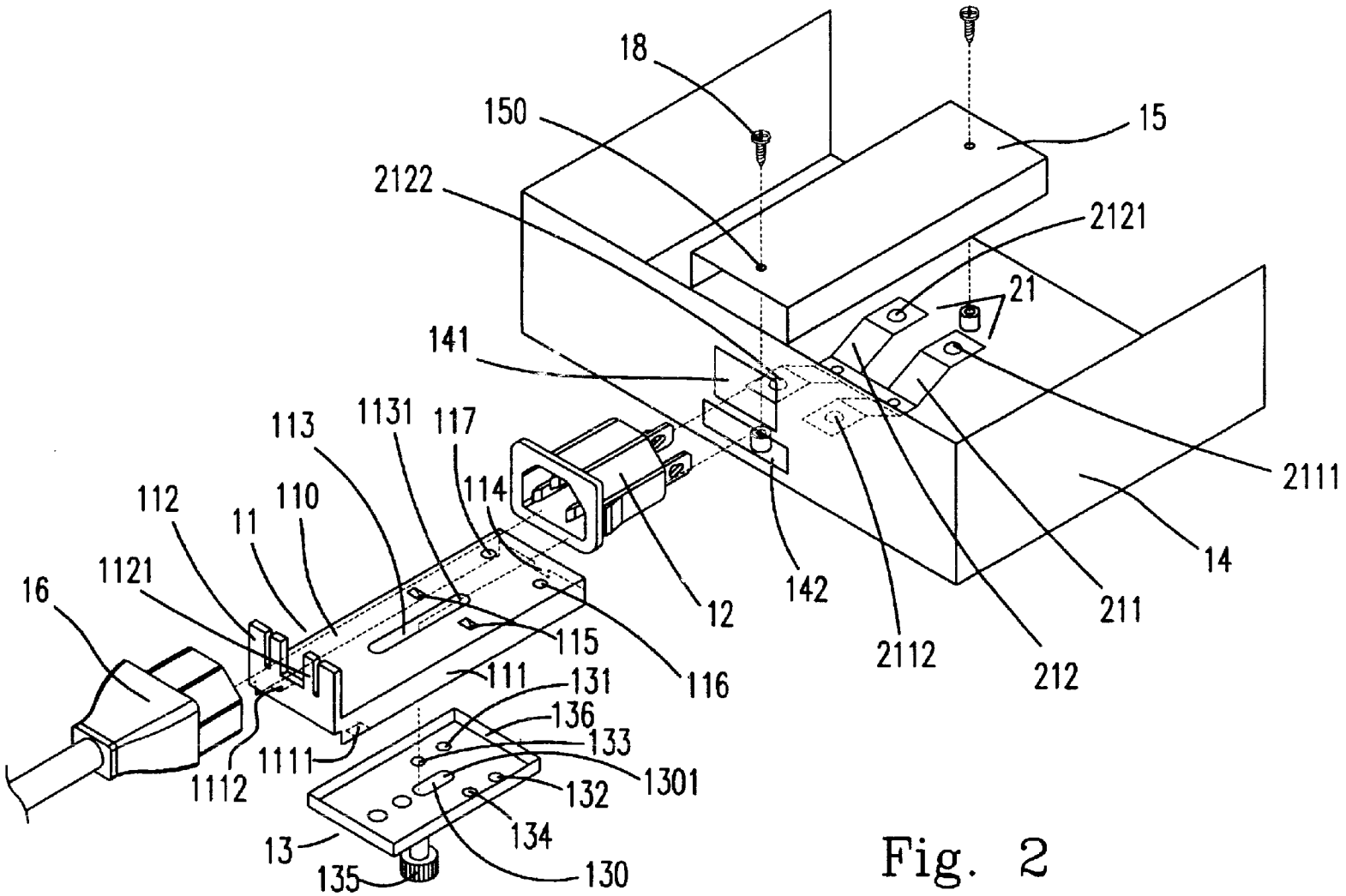
FIG. 2 is an exploded view showing every component present in FIG. 1.

As shown in FIG. 2, the resilient element 21 includes two resilient pieces (211 and 212) disposed on the bottom of the casing 114. Each of the resilient pieces (211 and 212) has a middle bended portion attached to the casing 14 and two free ends spaced apart a specific distance from the bottom of the casing, wherein each of two free ends has a tenon (2111, 2112, 2121, and 2122) thereon.

Please refer to FIG. 2. As shown in FIG. 2, the slider 13 includes a longitudinal slot 130, plural through holes 131, 132, 133, and 134, and a screw 135. The slider 13 is slidably mounted in the space defined by the undersurface and two L-shaped flanges 111 thereof and could be moved along the undersurface of the holder 11.

Portion of holder 11 and the slider 13 can be inserted into the second receptacle 142 of the casing 14. A screw 18 is mounted through a hole 150 of the cover 15, the longitudinal slot 113 of the holder 11, and the longitudinal slot 130 of the slider 13, whereby the cover 15 can be secured to the bottom of the casing 14 and define a channel for the holder 11 and slider 13 to slide therein. By the limitation of the screw 18, the holder 11 and the slider 13 can be moved outward and inward with respective to the casing 14 within a defined space.

The explanatory steps shown in FIGS. 3A to 3D are used to illustrate the operation of the adjustable securing device shown in FIG. 2 according to the preferred embodiment of the present invention. When an electric appliance is not used, the slider 13 and the holder 11 are pushed inward into the casing 14 for storage. In this situation, the slider 13 is locked via the engagement of the tenons (2112 and 2122) of the resilient element 21 and the through holes (133 and 134) thereof, and the holder 11 is locked via the engagement of the tenons (2111 and 2121) of the holder 11 and the through holes (116 and 117 thereof. Certainly, the casing 14 also can be designed to have an additional cover (not shown) for covering the exposed portion of the casing 14.

Figure 3A:
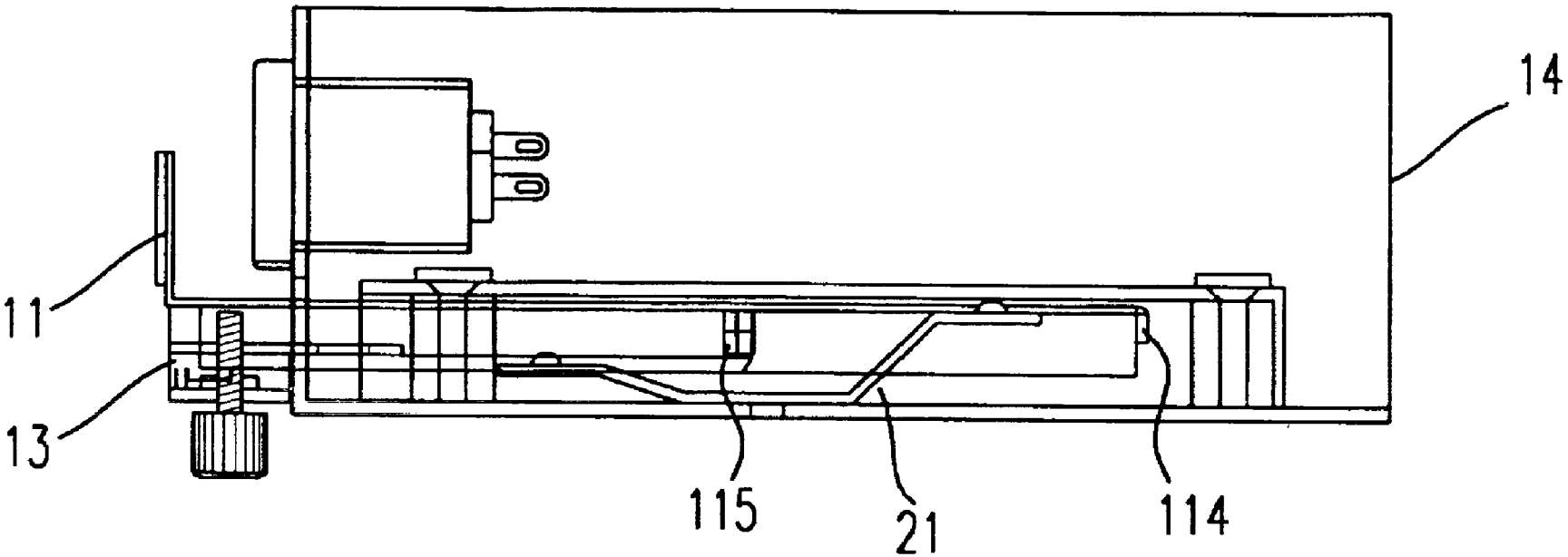
FIG. 3A is a schematic view of the adjustable securing device according to the preferred embodiment of the present invention, wherein the holder and the slider are pushed inward into the casing for storage.
Figure 3B:
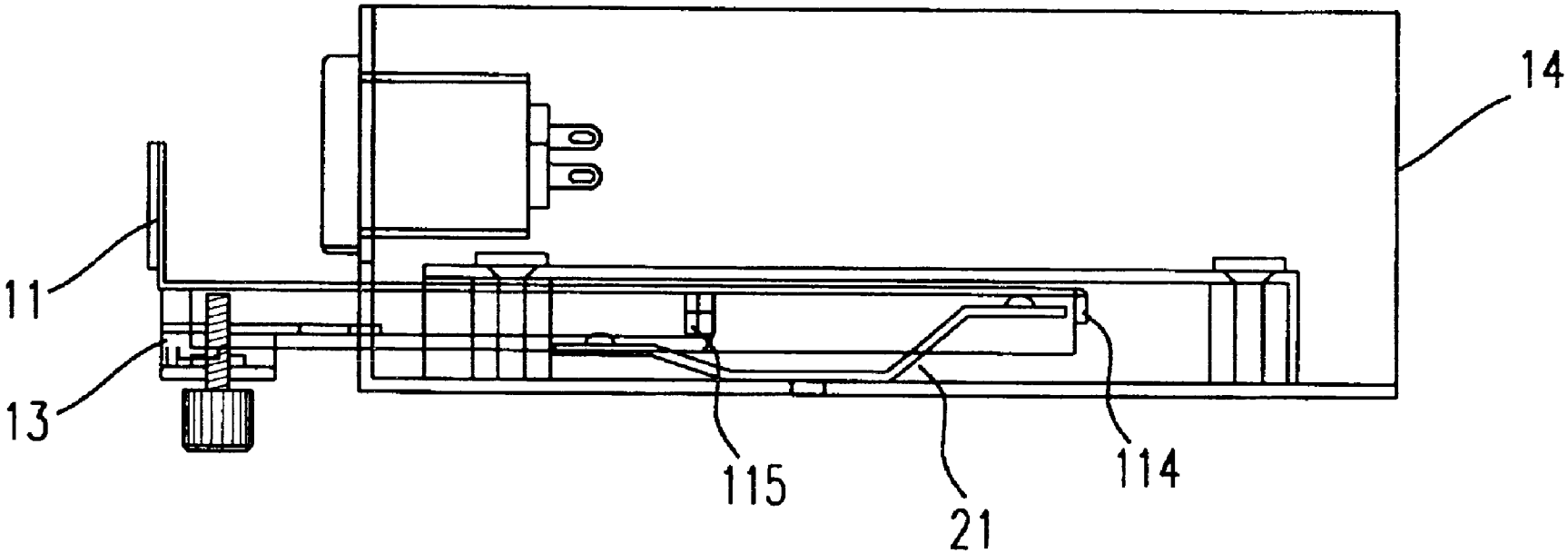
FIG. 3B is a schematic view of the adjustable securing device according to the preferred embodiment of the present invention, wherein the holder and the slider are pulled out.

As shown in FIG. 3B, when an electric applicant is going to be used, the holder 11 is pulled out. When the ear element 114 touches the rim 136 of the slider 13, the slider 13 is pushed outward by the ear element 114. Subsequently, when the rim 1301 of the longitudinal slot 130 of the slider 13 and the rim 1131 of the longitudinal slot 113 of the holder 11 touch the screw 18, the slider 13 is stopped and locked via the engagement of the tenons (2112 and 2122) of the resilient element 21 and the through holes (131 and 132) thereof and the holder 11 is stopped also, as shown in FIG. 3C.

Figure 3C:
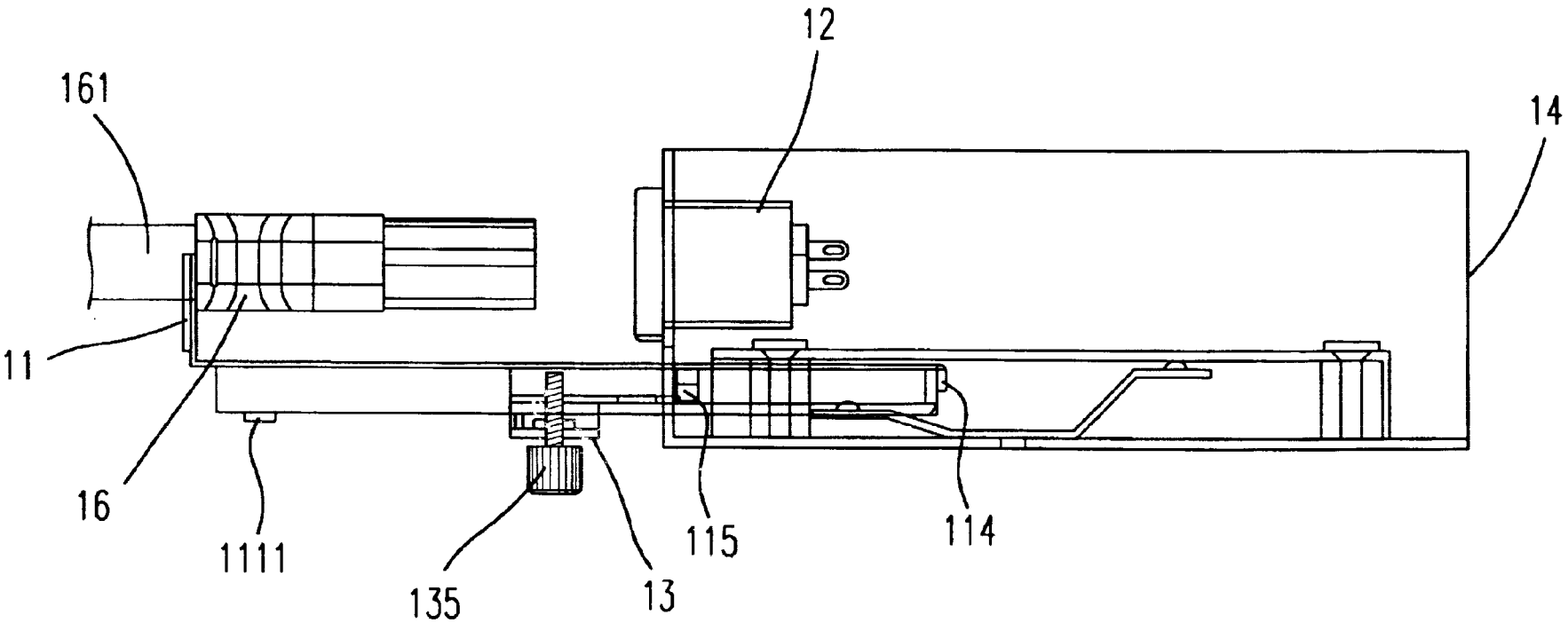
FIG. 3C is a schematic view of the adjustable securing device according to the preferred embodiment of the present invention, wherein the plug is carried on the holder.

Referring to FIG. 3C, the holder 11 is pulled most outward, and the plug 16 is secured on the holder 11 subsequently. The cable 161 of the plug 16 can be retained in the notch 1121 of the holder 11 to prevent the plug 16 from falling off.

Figure 3D:
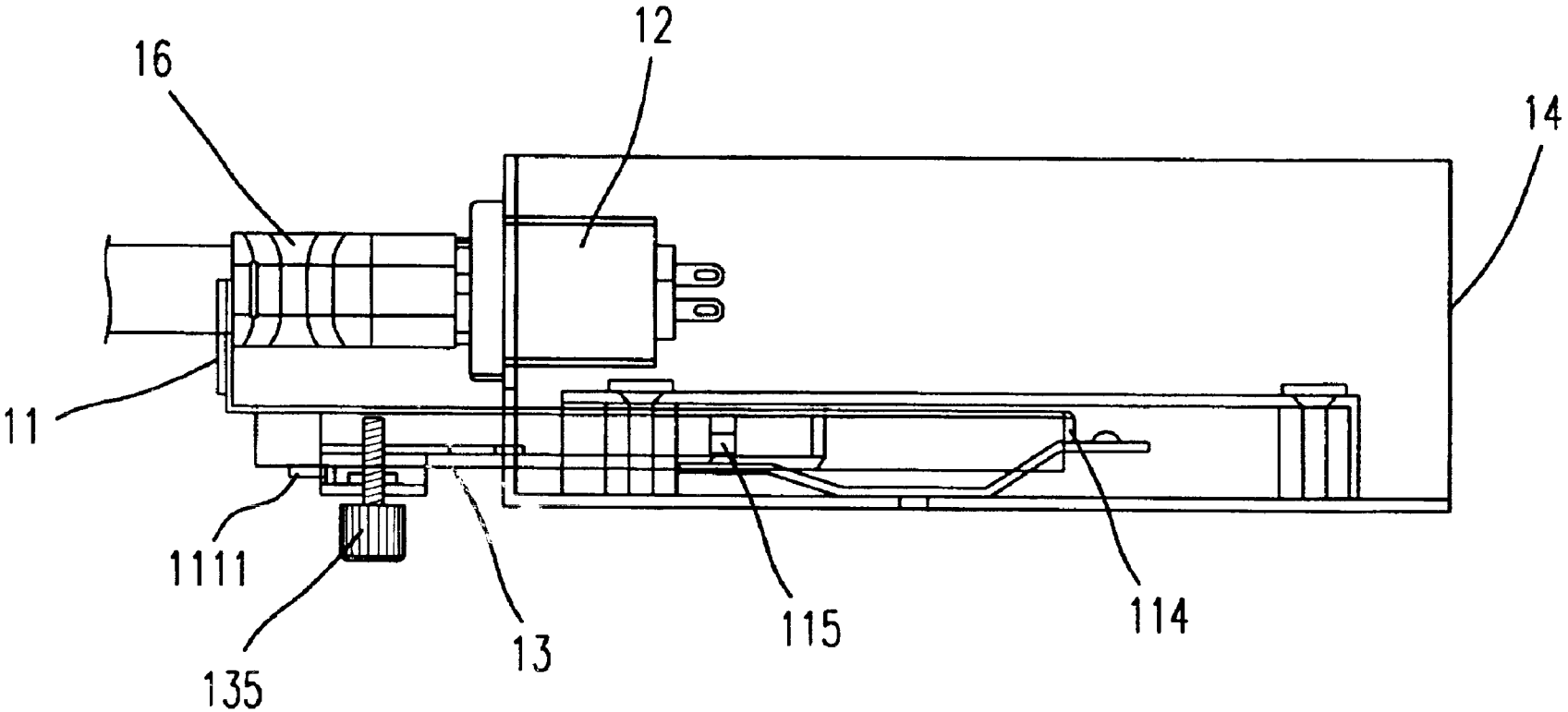
FIG. 3D is a schematic view of the adjustable securing device according to the preferred embodiment of the present invention, wherein the plug and socket are connected.

Referring to FIG. 3D, the holder 11 together with the plug 16 are pushed inward into the casing 14. When the ear element 115 touches the rim 136 of the slider 13, the slider 13 is also pushed inward by the ear element 115. Afterward, the connection of the plug 16 and the socket 12 is performed. Thereafter, when the plug 16 is tightly secured to the socket 12, the user can screw the screw 135 of the slider 13 to bias against the undersurface of the holder 11, thereby securing the holder 11 using the two fastenings 1111 and 1112 of the flanges 111 (as shown in FIG. 2) in a suitable position with respective to the casing 14 according to various sizes of the plug 16. Therefore, by using the adjustable securing device of the present invention, electric energy could be transferred into the electric appliance and user can adjust the securing device to secure the plug to the socket in response to various sizes of plugs.

Figure 4:
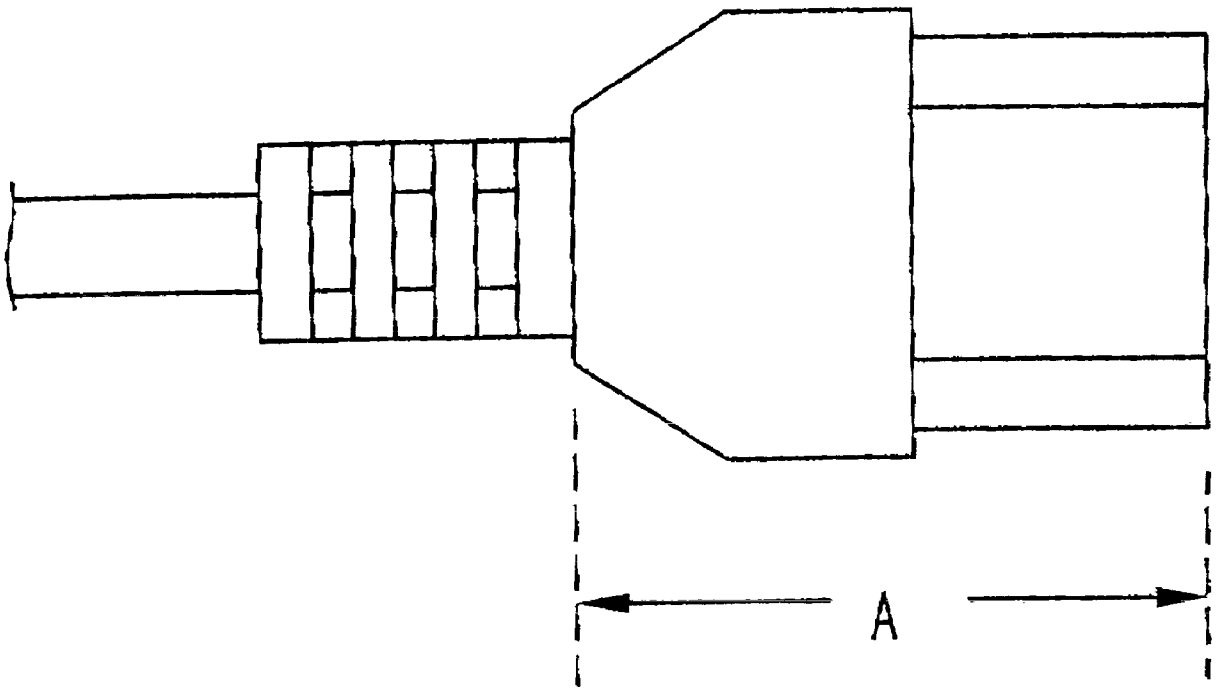
FIG. 4 is a side view of a plug capable of being secured to the adjustable securing device according to the present invention.

FIG. 4 is a side view of a plug, and the longitudinal length A of the plug head may be varied. Because the relative positions of the holder 11, slider 13 and the casing 14 are adjustable, the adjustable securing device provided by the present invention is adapted for tightly securing various sizes of plugs to the socket.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. An adjustable securing device capable of tightly securing various sizes of plugs to a socket for use in an electric appliance, comprising:

a casing having a first receptacle for retaining said socket therein and a second receptacle adjacent to said first receptacle;

a holder slidably mounted in said second receptacle of said casing and having one portion exposed from said casing for supporting and retaining said various sizes of plugs;

a resilient element disposed in said casing and having a first engaging element thereon; and a slider having a second engaging element for engaging with said first engaging element of said resilient element and slidably disposed under said holder for regulating and securing the position of said holder relative to said casing, thereby causing said various sizes of plugs to be tightly secured to said socket.

2. The adjustable securing device according to claim 1, further comprising a cover mounted in said casing for covering the other portion of said holder and guiding said holder and said slider to slide therein.

3. The adjustable securing device according to claim 2, wherein said cover has a hole for mounting a screw therethrough to secure said cover to said casing.

4. The adjustable securing device according to claim 3, wherein said holder has a first slot for mounting said screw therethrough, whereby said holder is capable of being slid in said second receptacle within the length of said first slot.

5. The adjustable securing device according to claim 4, wherein said slider has a second slot corresponding to said first slot of said holder for mounting said screw therethrough, whereby said slider is capable of being slid under said holder within the length of said second slot.

6. The adjustable securing device according to claim 1, wherein said resilient element includes at least one resilient piece, each of which has a middle bended portion attached to said casing and two free ends spaced apart a specific distance from the bottom of said casing, wherein said first engaging element is disposed on one of said two free ends.

7. The adjustable securing device according to claim 6, wherein said first engaging element of said resilient piece is a tenon and said second engaging element of said slider is plural holes for engaging with said tenon.

8. The adjustable securing device according to claim 7, wherein said holder further includes plural of through holes and said resilient piece further includes another tenon disposed on the other free end thereof for engaging with said through holes of said holder.

9. The adjustable securing device according to claim 1, wherein said slider further includes a screw for securing said holder to said slider by screwing said screw to bias against the undersurface of said holder when said holder is moved and regulated to a desired position relative to said casing, thereby tightly securing said various sizes of plugs to said socket.

10. The adjustable securing device according to claim 1, wherein said holder has a retaining element for retaining said plug thereon.

11. The adjustable securing device according to claim 1, wherein said holder further includes:

a plate; and two flanges downwardly extending from two opposite rims of said plate for defining a space with the undersurface of said plate to receive said slider.

* * * * *